US006082680A

United States Patent [19]

Woodward et al.

[11] Patent Number: 6,082,680

[45] Date of Patent: Jul. 4, 2000

[54] PEDESTAL SEAT SUPPORT

[75] Inventors: Bobby Leo Woodward, Mabank; Rex Allen Kirkland, Lancaster, both of Tex.

[73] Assignee: Brunswick Corporation, Tulsa, Okla.

[21] Appl. No.: 09/235,703

[22] Filed: Jan. 22, 1999

[51] Int. Cl.[7] ..... F16M 11/00

[52] U.S. Cl. ..... 248/1; 248/161; 248/413; 248/188.5; 114/363

[58] Field of Search ..... 248/161, 408, 248/413, 411, 188.5, 188.2, 407; 114/363; 297/344.22

[56] References Cited

U.S. PATENT DOCUMENTS

| | | | |
|---|---|---|---|
| 2,221,288 | 11/1940 | Okun | 248/408 |
| 3,126,901 | 3/1964 | Norkin | 135/35 |
| 3,195,848 | 7/1965 | Miller et al. | 248/411 |
| 4,014,507 | 3/1977 | Swenson | 248/407 |
| 4,030,749 | 6/1977 | Strahm | 297/345 |
| 4,185,936 | 1/1980 | Takashashi | 403/104 |
| 4,587,921 | 5/1986 | Currey | 114/363 |
| 4,627,591 | 12/1986 | Heckmann | 248/404 |
| 4,673,155 | 6/1987 | Binder | 248/404 |
| 4,977,848 | 12/1990 | Currey | 114/363 |
| 5,470,038 | 11/1995 | Clark | 248/156 |
| 5,833,182 | 11/1998 | Maus | 248/161 |
| 6,027,086 | 2/2000 | Heitlinger et al. | 248/188.5 |

*Primary Examiner*—Leslie A. Braun
*Assistant Examiner*—Walter Landry
*Attorney, Agent, or Firm*—Wood, Phillips, VanSanten, Clark & Mortimer

[57] ABSTRACT

The invention is a pedestal mount for a boat seat including means for locking the seat in selected rotational positions or permitting the seat to swivel in either direction. A cylindrical sleeve attached to the seat rotates within the vertical stanchion. A series of apertures in the sleeve are engaged by a locking pin to stop rotation of the seat in a selected position. A circumferential groove in the sleeve may be engaged by the locking pin, permitting the sleeve and seat to rotate but not be withdrawn from the stanchion. A collar around the top of the stanchion supports means for actuating the locking pin comprising a compression spring urging the pin into contact with the sleeve and a lever handle for selectively withdrawing the pin to a first position outside of the apertures but within the groove so that the seat may rotate but not be withdrawn from the stanchion, and a second position outside of the apertures and the groove so as to enable withdrawal of the sleeve end seat mount completely from the stanchion. Means for locking the stanchion within the supporting base comprise a locking lug extending outwardly near the lower end of the stanchion, which lug engages a locking slot in the receptacle of the base. The lug is urged into the locking position by a vertically disposed hairpin spring lodged within the stanchion. Means located on the stanchion above the base provide for depressing the spring and thereby withdrawing the lug from the locking position. The sleeve is a stepped cylinder, a central portion of which has the same diameter as the support stanchion, enabling the sleeve to be inserted directly into the base support without use of the stanchion.

7 Claims, 4 Drawing Sheets

PEDESTAL SEAT SUPPORT

FIELD OF THE INVENTION

The field of the invention is pedestal supports for individual seats having particular application in the marine environment.

BACKGROUND OF THE INVENTION

Fishing boats, particularly fishing boats known as bass boats and the like, frequently employ individual seats for the fishermen. Such seats may be mounted on individual pedestals extending upwardly from the deck of the boat, some adjustable in height, and may provide for the seat to swivel on the pedestal. Illustrations of such pedestals and seats designed for mounting thereon may be found in the catalog of boating equipment published by the West Marine Company of 560 West Ridge Drive, Watsonville, Calif. 95076, entitled "1998 Power Boat Master Catalog", pages 483–485 and 488–493. These pages are hereby incorporated in this specification by reference.

The pedestal seat configuration described herein enables the user to lock his or her seat in any one of four directional positions and to free the seat for unrestricted rotation in either direction without fear of the seat becoming detached from the pedestal. In addition, a reinforced locking lug structure adds strength and safety to the features holding the pedestal securely to the boat deck.

SUMMARY OF THE INVENTION

The invention is a pedestal type support for a seat intended primarily for installation on a boat. A swiveling seat support is mounted in the top of a vertical stanchion which is inserted in a base support member affixed to the deck of the boat. A standard marine seat mount is mated with the top of a cylindrical sleeve which slides into the top of the vertical stanchion. The sleeve has a plurality of apertures disposed around a diameter thereof and an annular groove cut therein around the same diameter. A locking pin mechanism mounted around the top of the stanchion provides means for moving a locking pin through a hole in the side wall of the stanchion and into engagement with a selected one of the apertures in the sleeve or, alternatively, into engagement solely with the annular groove. The locking pin mechanism comprises a spring for biasing the pin inwardly toward the sleeve and a lever handle for selectively withdrawing the pin to a first position outside the apertures but still within the groove, so that the sleeve and attached seat are free to rotate but not separate from the stanchion, and a second position outside of the groove so that the sleeve and seat may be completely withdrawn from the stanchion. The first position of the pin being achieved by pushing down on the handle and the mechanism being so configured that the handle will remain in the down position when placed there by the operator. The second position of the pin is achieved by raising the lever handle to the point where the pin is withdrawn completely from the sleeve.

A further feature of the invention includes means for locking the stanchion in the base, wherein the base comprises a cylindrical receptacle for the stanchion set into the deck of the boat. The receptacle has a cylindrical wall with a detent therein positioned to receive a locking lug extending through the wall of the stanchion positioned to engage the detent when the stanchion is shoved into the base receptacle. The lug is urged outwardly by a spring lodged within the stanchion. Means are provided above the base for acting upon the spring so as to withdraw the lug from the detent so that the stanchion may be withdrawn from the deck. The spring and lug comprise a molded plastic piece in which a stainless steel pin is molded within the lug in the area of its engagement with the detent in the wall of the base to avert shearing of the lug from the spring under heavy load conditions. The base receptacle is provided with a liner bushing to provide a snug fit and prevent wobble of the inserted stanchion.

In a further feature of the invention, the cylindrical sleeve is stepped so as to provide a cylindrical section sized to snugly fit within the receptacle in the base, so that the sleeve and attached seat may be mounted in the base without the vertical stanchion and locking pin mechanism. A cylindrical bar extends downwardly from the marine seat mount through an axial bore in the sleeve to a position below the sleeve. An annular groove in the lower end of the bar engages the periphery of a hole in the bottom of the liner bushing of the base receptacle. The hole is sized and the liner is sufficiently elastic to permit the lower end of the bar to be pressed through the hole until the groove is engaged by the periphery of the hole so as to retain the sleeve and seat mount in place.

DETAILED DESCRIPTION OF THE INVENTION

Figure 1:
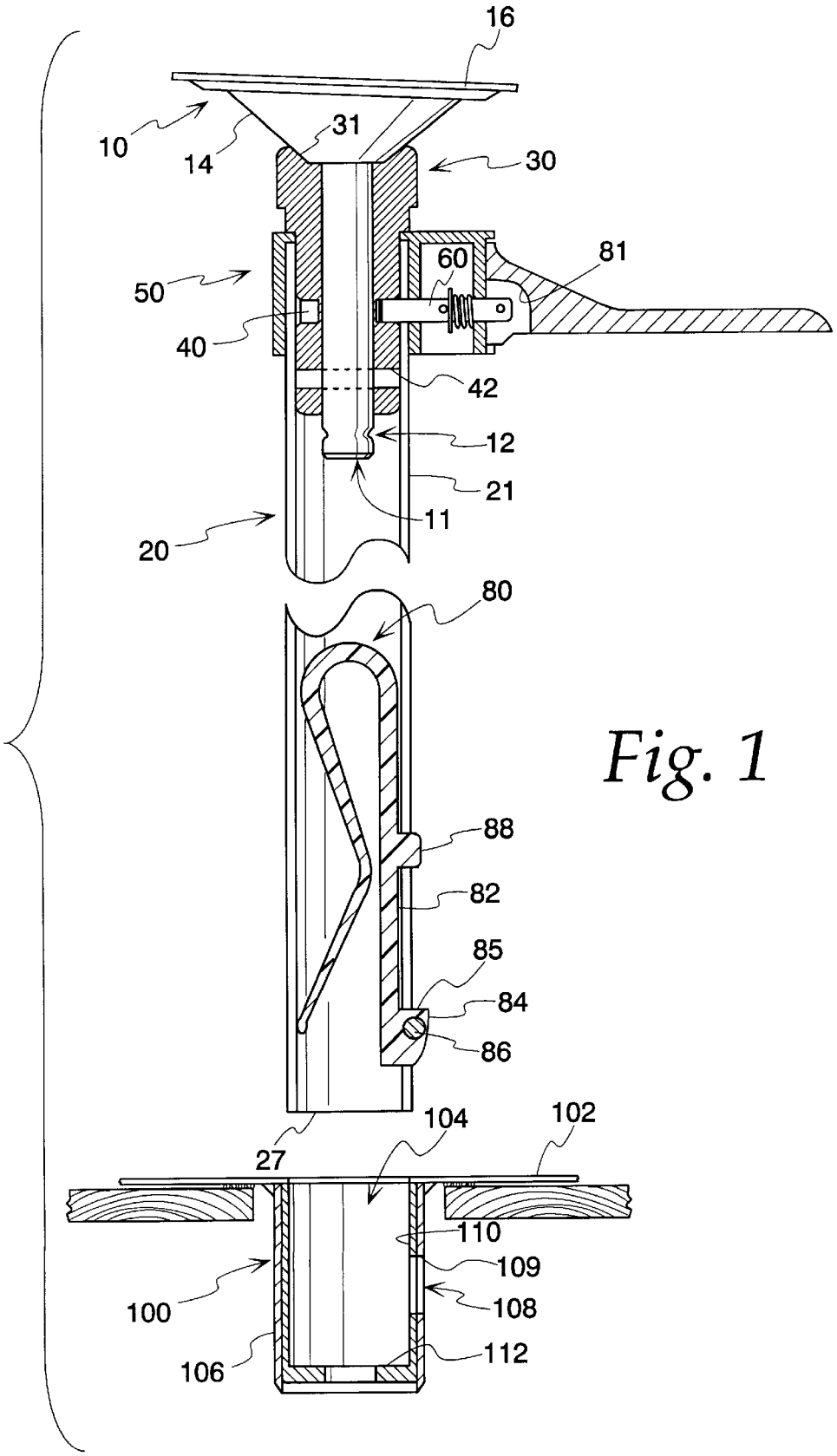
FIG. 1 is a cross-sectional view of a side elevation of the seat mount assembly of the invention positioned for insertion into the base.

Referring to FIG. 1, the seat mount 10 is assembled to the locking sleeve 30. The seat mount 10 is comprised of a conical body 14 having a flanged top 16 containing a hole pattern (not shown) compatible with individual seats currently available on the market and shown in the West Marine catalog. The top 31 of the sleeve 30 is concave, matching the underside of the conical body 14 of the seat mount 10. A cylindrical bar 11 is attached to and extends downwardly from the seat mount 10 through the sleeve 30. A stainless steel grooved pin (not shown) is pressed into a bore 42 which extends through the lower portion of the sleeve 30 and the bar 11 to secure the bar and the seat mount 10 to the sleeve 30. An annular groove 12 is cut into the lower end of the bar 11, the purpose of which is described below.

The seat mount 10 and locking assembly described below are supported by a tubular vertical stanchion 20 made of aluminum having a diameter of 1.77 inches and a wall 21 with a thickness of 0.130 inches. A collar 50 of the locking assembly fits around and sits atop the stanchion 20. The sleeve 30 slides downwardly through the top of the collar 50 and into the interior tubular stanchion 20. The cylindrical sleeve 30 is so sized with respect to the interior diameter of the stanchion 20 as to be free to rotate therein but not wobble.

The central portion of FIG. 1 illustrates the position of the hairpin-shaped locking spring 80 and its integral locking lug 84 and release button 88, the structure and function of which will be described below.

The bottom part of FIG. 1 illustrates the base member 100 of the invention which comprises a flat plate 102 (see also FIG. 6A) and a cylindrical receptacle section 104 which extends downwardly of the plate 102 so as to extend below the deck of the boat to which the base 100 is attached by suitable screws or bolts. A nylon liner 110 fits tightly into the base receptacle 104. A locking slot 108 is cut through the wall 106 of the base receptacle 104 and through the liner 110 in a position to accept the locking lug 84 protruding from the stanchion 20 when the stanchion 20 is fully inserted into the base receptacle 104. The locking slot is rectangular in shape to receive therethrough the locking lug 84 and has a straight horizontal upper edge 109 positioned to engage the flat top edge 85 of the lug 84 when the stanchion 20 is fully inserted into the base receptacle 104, so as to prevent inadvertent removal of the stanchion 20 from the base 100.

Figure 2:
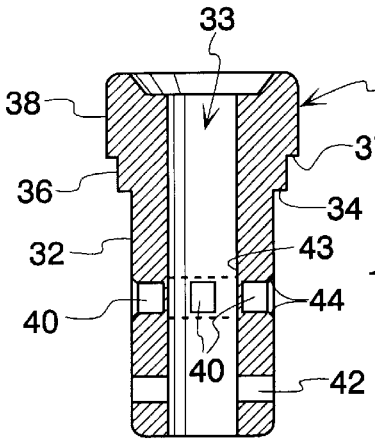
FIG. 2 is a cross-sectional view of the sleeve of the invention.

Referring to FIG. 2, the sleeve 30 is a stepped cylinder preferably made of machined Delrin having an elongate lower cylindrical section 32 of a smallest diameter sized to fit within the tubular stanchion 20, a middle cylindrical section 36 having a diameter equal to the outside diameter of the stanchion 20, and an upper cylindrical section 38 having a diameter larger than the outside diameter of the stanchion 20. A step between the lower section 32 and middle section 36 forms a shoulder 34 which rests upon a top lip 51 of the collar 50 (described below) which extends over the top cylindrical edge 24 of the stanchion 20. The middle cylindrical section 36 of the sleeve 30 is sized to fit snugly within the lined base receptacle 104. The step between the middle 36 and upper 38 cylindrical sections of the sleeve 30 form the shoulder 37 which rests upon the base plate 102 of the base 100 when the sleeve 30 and seat mount 10 are inserted within the base 100 as described below. A bore 33 extends axially downwardly through the cylindrical sleeve 30 and is sized to closely receive therein the cylindrical bar 11 extending downwardly from the seat mount 10. The top surface 31 of the sleeve 30 is concave, forming a conical support for the cone-shaped body 14 of the seat mount 10.

A series of four square apertures 40 is cut or molded into the first cylindrical section 32 of the sleeve 30 which fits into the stanchion 20. The apertures 40 do not extend through the inside side wall 43 of the sleeve 30. The apertures 40 are 90° apart and centered on a common diameter of the sleeve so as to permit four radial locked positions for the seat when engaged by the locking pin 60.

A bore 42 extending laterally through the lower section 32 of the sleeve 30 accommodates a grooved pin (not shown) which permanently pins the sleeve 30 to the cylindrical bar 11 extending downwardly from the seat mount 10 through the bore 33 in the sleeve 30, so that the seat mount 10 and the sleeve 30 function as a unitary assembly.

An annular rectangular groove 44 is machined into the sleeve 30. The width of the groove 44 is slightly larger than the height of the apertures 40, so that its upper edge is slightly above the apertures 40 and its lower edge is slightly below the apertures 40.

Figure 3:
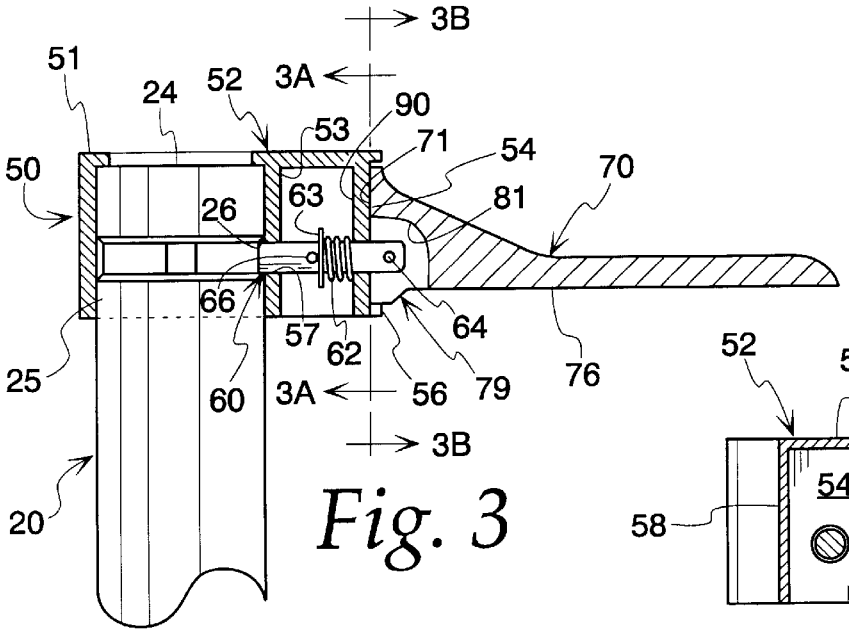
FIG. 3 is a cross-sectional view of the locking pin mechanism of the invention showing the pin fully inserted through the side wall of the stanchion.

Referring to FIG. 3, the locking pin 60 and actuating elements are supported by a cylindrical collar 50 and integral housing 52 which may be injection molded. The collar 50 fits over and around the upper end 25 of the stanchion 20. An annular lip 51 of the collar 50 overlies the upper annular edge 24 of the stanchion 20 and lies in-between the edge 24 and the shoulder 34 of the sleeve 30 when the sleeve 30 is slid into the top of the stanchion 20.

Referring to FIG. 3, a rectangular box housing 52 integral with the collar 50 extends laterally from the collar 50 and is comprised of right and left vertical side walls 56 and 58, respectively, a top 59, and an outer wall 54 spaced from the wall 53 of the annular collar 50. The bottom of the box housing 52 is open. The outer wall 59 of the housing 52 is spaced about 0.900 inches from the wall 53 of the annular collar 50. A lateral bore 57 axially aligned with and sized to match a hole 26 in the stanchion 20 extends through the outer wall 54 of the housing 52 and the wall 53 of the collar 50. The locking pin 60 is slidably mounted within the bore 57 so as to extend through the collar wall 52 and the hole 26 in the stanchion 20 into engagement with the sleeve 30. A bushing 55 may be installed in the hole 24 to align and ease movement of the locking pin 60. The pin 60 is fastened by a roll pin 64 to a handle 70 positioned adjacent to the outer wall 54 of the housing 52. A flat inner end 71 of the handle 70 is held against the outside 59 of the wall 54 by the action of a compression spring 62 disposed between the inside 90 of the wall 54 and a nylon washer 63 disposed around the pin 60. The washer 63 is so positioned on the pin 60 as to compress the spring 62, forcing the pin 60 inwardly into engagement with the sleeve 30. The nylon washer 63 is held in place by a cotter pin 66 extending through the locking pin 60. The spring 62 urges the locking pin 60 into the groove 44 or the locking apertures 40 when aligned therewith. The spring 62 holds the flat end 71 of the handle 70 flat against the outside 59 of the wall 54 so tht the handle 70 extends at right angles to the stanchion 20 until it is moved by the operator.

Figure 3A:
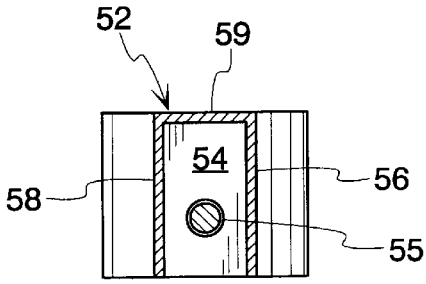
FIG. 3A is a cross-sectional view taken along line 3A—3A of FIG. 2.

Referring to FIGS. 3 and 3A, the inner end 71 of the handle 70 has a rectangular periphery, with a height and width slightly less than the interior dimensions of the housing 52. The side walls 56 and 58 of the housing 52 extend outside the outer wall 54 and alongside the rectangular inner end 71 of the handle 70 so as to prevent twisting of the handle 70 and the pin 60 when the handle 70 is raised or lowered, as explained below.

Figure 3B:
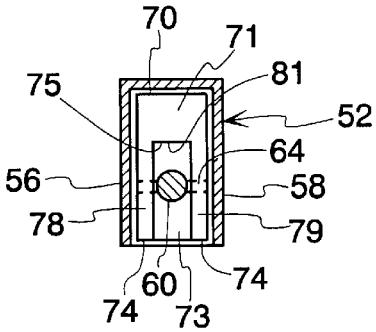
FIG. 3B is a cross-sectional view taken along line 3B—3B of FIG. 2.
Figure 4:
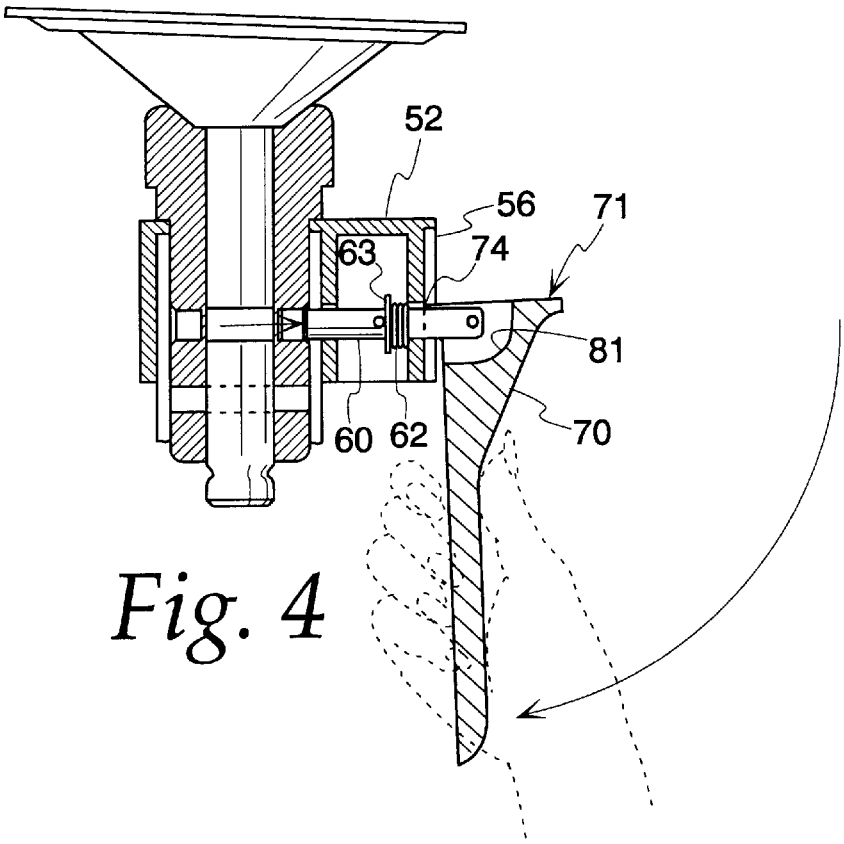
FIG. 4 is a cross-sectional side view of the invention illustrating the control handle in the down position and the locking pin engaged solely in the groove of the sleeve.
Figure 5:
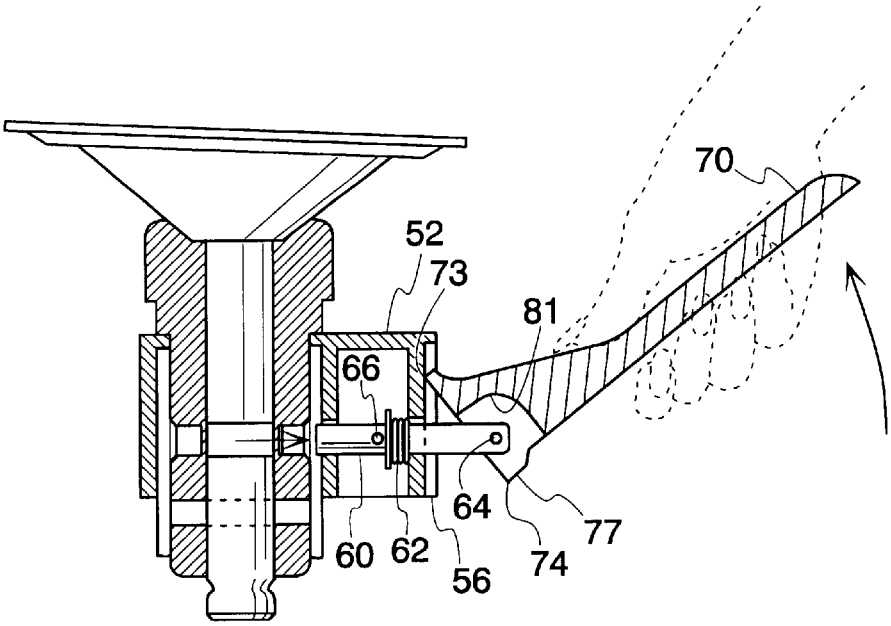
FIG. 5 is a cross-sectional view of the invention illustrating the control handle raised to the position where the locking pin is withdrawn from all engagement with the sleeve.

Referring to FIGS. 3*b*, 4 and 5, the end face 71 of the handle 70 has an axial slot 75 cut therein defined by an inner wall 81 and side walls 78 and 79. The roll pin 64 extends through the left 78 and right 79 side walls of the slot 75 in the handle 70 and the locking pin 60. As the handle 70 is raised or lowered, the slot 75 accommodates movement of the pin 60 relative to the handle 70. Since the handle 70 may be moved to the full down position, the slot 75 must extend through the bottom edge 76 of the handle 70.

Referring to FIGS. 3*b* and 4, the lower edges 74 of the end face 71 of the handle 70 function as a fulcrum when the handle 70 is lowered, causing the locking pin 60 to be withdrawn from the locking apertures 40 but not the groove 44 of the sleeve 30. With the handle 70 pushed all the way down, the flat lower edges 77 of the side walls 78 and 79 of the slot 75 in the handle 70 lie against the outside surface 59 of the wall 54 and function in cooperation with the action of the spring 62 to retain the handle 70 in the full down position. With the handle 70 resting in the full down position, the sleeve 30 and seat mount 10 are free to rotate within the stanchion 20, but may not be withdrawn from the stanchion 20 because the pin 30 is still engaged within the groove 44.

Referring to FIG. 5, the upper edge 73 of the end face 71 of the handle 70 functions as a fulcrum when the handle 70 is lifted, causing the locking pin 60 to be drawn outwardly through the bore 57. This action is sufficient to withdraw the pin both from the locking apertures 40 and the locking groove 44, thus enabling withdrawal of the sleeve 30 and seat mount 10 from the stanchion 20. The distance between the roll pin 64 which attaches the pin 60 to the handle 70 and the fulcrum edge 72 must be great enough to enable this action. The handle 70 operates as a simple lever, and since the pin must move within the bore 57, the top edge 73 of the handle will slide down the outside face 59 of the wall 54 as the handle is raised.

Figure 6:
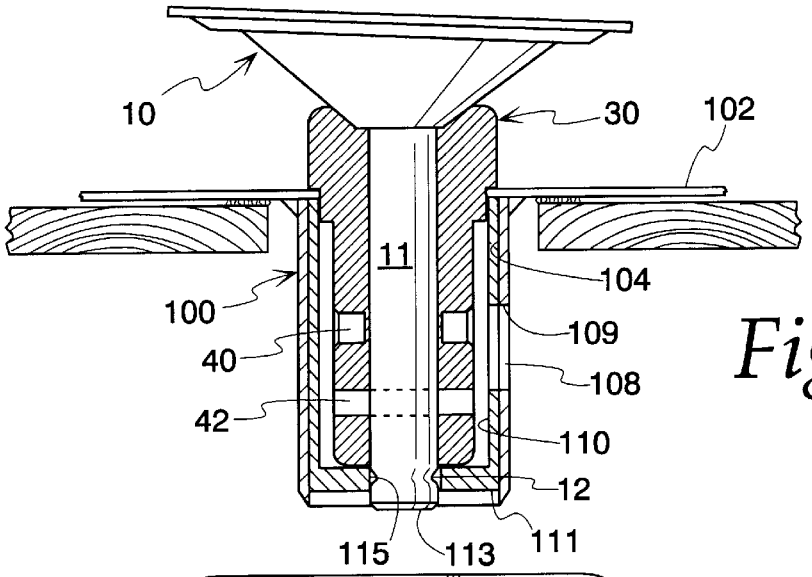
FIG. 6 is a cross-sectional view illustrating the sleeve and seat mount assembly inserted into the base of the invention.

Referring to FIG. 6, the sleeve 30 with seat mount 10 attached is shown positioned within the mounting base 100. The cylindrical bar 11 extending downwardly from the seat mount 10 extends through an aperture 115 in the bottom 111 of the plastic liner bushing 110 in the base receptacle 104. The aperture 115 in the plastic liner 110 is sized to permit the bottom end 13 of the bar 11 to deform and penetrate the aperture 115 in the liner 110 until the liner engages the annular groove 12 in the lower end of the bar 11, whereby the sleeve 30 and the seat 10 are removably held within the base 100.

Figure 6A:
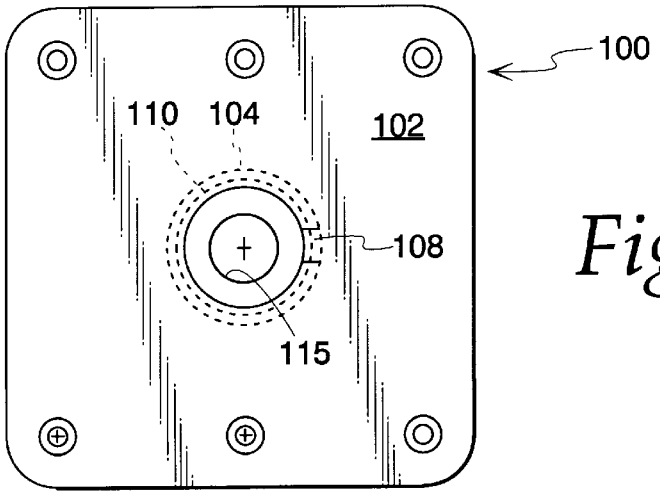
FIG. 6A is a top view of the base of the invention.

FIG. 6A illustrates the relative size of the base plate 102 to the size of the receptacle 104 and the liner 110.

Figure 7A:
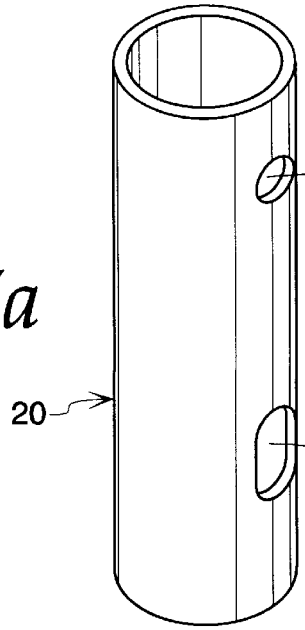
FIG. 7A is a perspective view of the lower portion of the stanchion showing the holes therein through which the locking lug and release button illustrated in FIG. 7B extend.
Figure 7B:
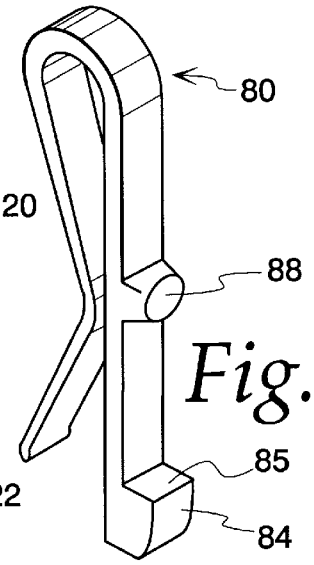
FIG. 7B is a perspective view of the integral spring, locking lug, and locking lug release button of the invention.

FIGS. 7A and 7B, together with FIG. 1, illustrate the nature, interaction, and function of the locking spring clip 80 with the stanchion 20 and the base 100. The hairpin-shaped spring 80 may be injection molded so as to create a release button 88 toward the middle of the straight arm 82 and a locking lug 84 at the lower end of the arm 82. The spring 80 is sized to fit snugly within the stanchion 20 with the release button 88 protruding through an aperture 120 in the side wall 21 of the stanchion 20, and the locking lug 84 protruding through an aperture 122 toward the lower end of the stanchion 20. The spring 80 may be pushed up into the stanchion 20 from the lower end until the buttons 88 and lug 84 fall into the respective apertures 120 and 122.

Referring to FIG. 1, a reinforcing pin 86 is preferably molded into the locking lug 84 to reinforce the lug against the shearing forces encountered in use. In operation, the stanchion 20 assembly is inserted into the base 100 with the bottom edge 27 of the stanchion 20 resting against the bottom 112 of the liner 110, at which point the lug 84 will engage the locking slot 108 cut through the side wall 106 of the base 100 and the liner 10. In this position, the top flat surface 85 of the lug 84 will engage the upper edge 109 of the locking slot 108 so as to prevent the stanchion 20 from coming out of the base 100 inadvertently. The stanchion 20 is released from the base 100 by pressing inwardly upon the release button 88, which moves the arm 82 of the spring 80 inwardly of the stanchion 20, moving the lug 84 out of the locking slot 108 and releasing the stanchion 20 from the base 100.

The foregoing disclosure of specific embodiments is intended to be but one illustration of the broad concepts comprehended by the invention.

We claim:

1. A pedestal seat support for a boat comprising:

a seat mount;

a vertical stanchion having a walled cylindrical aperture in the upper end adopted to receive a cylindrical sleeve;

base plate means for attaching the vertical stanchion to the deck of a boat; and means for attaching the seat mount to the stanchion, comprising an elongate cylindrical sleeve sized to fit within the cylindrical aperture in the upper end of the stanchion comprising a plurality of locking apertures and a groove encircling the sleeve and communicating with the locking apertures, a locking pin slidingly mounted for movement laterally through the wall of the cylindrical aperture in the stanchion into and out of engagement with the sleeve, spring means for biasing the locking pin into engagement with the sleeve, means for moving the locking pin comprising a lever for selectively withdrawing the pin against the action of the spring to a first position outside the apertures but within the groove to permit rotation of said seat and prevent the seat's removal, and a second position outside the apertures and the groove so that the sleeve and seat mount may be removed from the pedestal.

2. The pedestal seat support of claim 1 wherein the means for moving the locking pin comprises a collar around the top of the vertical stanchion, a lever support wall spaced a selected distance outwardly of the stanchion, a lever handle disposed outwardly of and adjacent to the support wall, roll pin means for rotatably connecting the locking pin to the lever, a stop washer attached to the locking pin inside the support wall and a compression spring disposed between the support wall and the stop washer so as to urge the locking pin into engagement with the sleeve.

3. The pedestal seat of claim 2 wherein the lever comprises a handle having a first portion in contact with the support wall sufficiently above the pin to enable complete withdrawal of the pin from contact with the sleeve when the handle is lifted, and a second portion in contact with the support wall sufficiently below the pin to enable withdrawal of the pin from the apertures in the sleeve but not the groove when the handle is pushed to the down position, and means for retaining the handle in the down position.

4. The seat support of claim 1 wherein the base plate comprises a cylindrical receptacle sized to receive therein a selected portion of the vertical stanchion, flange means extending from the receptacle for mounting the receptacle to the deck of a boat, a slot in a side of the base receptacle below the boat deck, a springloaded locking lug extending outwardly of the stanchion for locking engagement with a top edge of the slot when the stanchion is fully inserted in the receptacle, and means positioned above the base plate for causing withdrawal of the locking lug from the slot in the base receptacle so that the stanchion may be withdrawn from the base a receptacle.

5. The seat pedestal of claim 1 wherein the cylindrical sleeve is stepped so as to comprise a lower cylindrical portion sized to fit within the cylindrical aperture in the stanchion, a first annular shoulder sized to engage the top edge of the stanchion, an intermediate cylindrical portion sized to snugly fit within the receptacle in the base plate and a second annular shoulder sized to engage the flange of the base plate, so that the seat supporting sleeve may be fitted directly into the base plate without the vertical stanchion.

6. The seat pedestal of claim 4 wherein the springloaded locking lug comprises a hairpin-shaped spring disposed within the stanchion, the spring comprising a vertical leg, the locking lug extending from the lower end of the vertical leg, and a release button projecting from the vertical leg of the spring through a hole in the wall of the stanchion above the base plate, whereby pressure on the release button withdraws the locking lug from the hole in the base receptacle.

7. The seat pedestal of claim 6 wherein the spring is constructed of molded plastic and the locking lug comprises a steel pin encased therein.

* * * * *